United States Patent [19]

Becker et al.

[11] 4,070,672

[45] Jan. 24, 1978

[54] ANSWERING DEVICE FOR A SYSTEM FOR THE AUTOMATIC WIRELESS TRANSMISSION OF MULTI-POSITION DATA BETWEEN INTERROGATION DEVICES AND ANSWERING DEVICES MOVABLE WITH RESPECT TO ONE ANOTHER

[75] Inventors: Friedbert Becker; Karl Laufer; Johann Albert Steinkamp, all of Munich, Germany

[73] Assignee: Siemens Aktiengesellschaft, Berlin & Munich, Germany

[21] Appl. No.: 703,841

[22] Filed: July 9, 1976

[30] Foreign Application Priority Data

July 11, 1975 Germany ..... 2531148

[51] Int. Cl.[2] ..... G01S 9/56

[52] U.S. Cl. ..... 343/6.8 R; 343/6.5 SS

[58] Field of Search ..... 343/6.5 SS, 6.8 R

[56] References Cited

U.S. PATENT DOCUMENTS 3,299,424 1/1967 Vinding ..... 343/6.8 R X 3,353,178 11/1967 Wasterlid ..... 343/6.5 SS

*Primary Examiner*—T.H. Tubbesing

*Attorney, Agent, or Firm*—Hill, Gross, Simpson, Van Santen, Steadman, Chiara & Simpson

[57] ABSTRACT

An answering device in a system for automatic wireless transmission of an item of information coded by a plurality of frequencies is disclosed herein. An interrogation device movable with respect to the answering device transmits an interrogation signal having a frequency which periodically varies within a predetermined microwave frequency band. The answering device has a plurality of microwave resonators, each of which has a fixed frequency. A microwave diode is coupled to each of the resonators for preventing a response to the interrogation signal by either damping or detuning the resonator fixed frequency when a control voltage is applied. The control voltage means connected to each of the microwave diodes switches certain of the resonators to an inoperative condition to establish a set of frequencies at which the resonators will respond which corresponds to the information to be transmitted.

5 Claims, 6 Drawing Figures

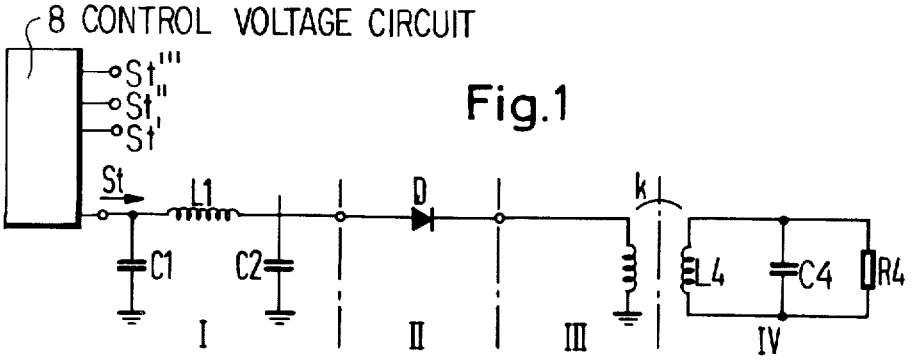
Fig.1
Fig. 2
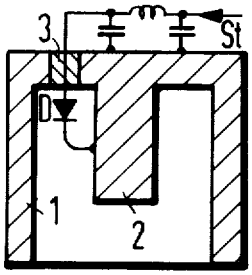
Fig. 3
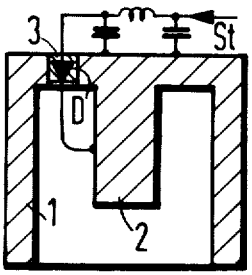
Fig. 4
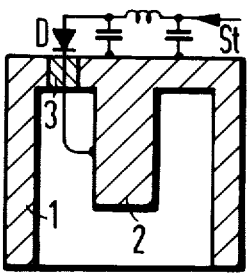
Fig.5
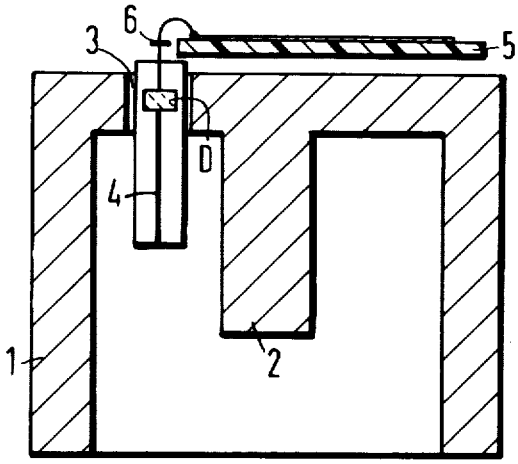

ANSWERING DEVICE FOR A SYSTEM FOR THE AUTOMATIC WIRELESS TRANSMISSION OF MULTI-POSITION DATA BETWEEN INTERROGATION DEVICES AND ANSWERING DEVICES MOVABLE WITH RESPECT TO ONE ANOTHER

BACKGROUND OF THE INVENTION

1. Field of the Invention

This invention relates to answering devices and more particularly to answering devices for microwave interrogation signals.

2. Prior Art

This invention concerns an answering device in a system for the automatic wireless transmission of multi-position or multi-digit data between interrogation devices and answering devices which are movable with respect to one another and wherein the carrier moving either of the devices has an energy supply. Particularly, identifying numbers of railway vehicles may be transmitted to stationary interrogation devices. The interrogation device transmits an interrogation signal having a frequency which periodically varies within a predetermined frequency band situated within the microwave region. As the respective answering device moves past the interrogation device, the answering device selects frequencies corresponding to a multi-position item of information by use of filters consisting of high-frequency line resonators tuned to resonate at predetermined frequencies. The answering device sends back to the interrogation device a predetermined number of answering frequencies for the information being transmitted. Each answering device is provided with a high frequency line segment to which each of the filters for the frequencies to be selected are coupled. The filters formed by the resonators may be individually switched inoperative through a control voltage circuit by use of strong detuning or strong damping in order to establish the proper coding for the item of information in the answering device.

An answering device of this type is prior art through German Letters Pat. No. 1,901,890. In the case of resonators constructed as coaxial or hollow waveguides, a movable pin is provided for each resonator which is capable of being dipped into the resonator when needed to detune or dampen the same.

SUMMARY OF THE INVENTION

An object which is the basis of this invention is to improve the prior art answering device such that a defined or total detuning or a strong damping of the microwave resonator is possible without mechanically moving parts.

The problems in the prior art are solved in accordance with this invention by providing a microwave diode with each resonator wherein the diode is coupled to the resonator such that by applying control voltages to the microwave diode, the resonator is detuned or damped.

In addition to the high switching speed, a much greater reliability and life span is achieved since a fully electronic remote adjustment of the answering device is provided rather than the remote positioning of mechanically movable parts. In addition, the switching conditions of the diodes may be monitored in a simple manner to increase reliability.

Preferably, a PIN diode (an intrinsic region between P and N-type regions) is used as the microwave diode. This diode may be operated as a controllable microwave resistance. Also, a varactor diode may be used as a controllable capacitance effective at microwave frequencies.

In an answering device having resonators constructed according to coaxial or hollow waveguide-type technology, coupling of the microwave diode to the resonator preferably takes place via an inductive element on a head portion. The microwave diode is preferably constructed as a diode chip and integrated into the coupling element which is then inserted into an aperture of the resonator head portion. It is also preferable to mount the lines for supply of the control voltage to the microwave diode on a bar plate arranged on the external side of the head portion of the resonator. It is also useful to couple capacitively by use of a switching antenna.

BRIEF DESCRIPTION OF THE DRAWINGS

FIG. 1 illustrates the equivalent circuit diagram of a microwave resonator with a connected diode circuit;

FIGS. 2–4 illustrate various arrangements of the microwave diode in the resonator;

FIG. 5 illustrates an embodiment of a switchable resonator having an insertable coupling section.

DESCRIPTION OF THE PREFERRED EMBODIMENTS

Figure 6:
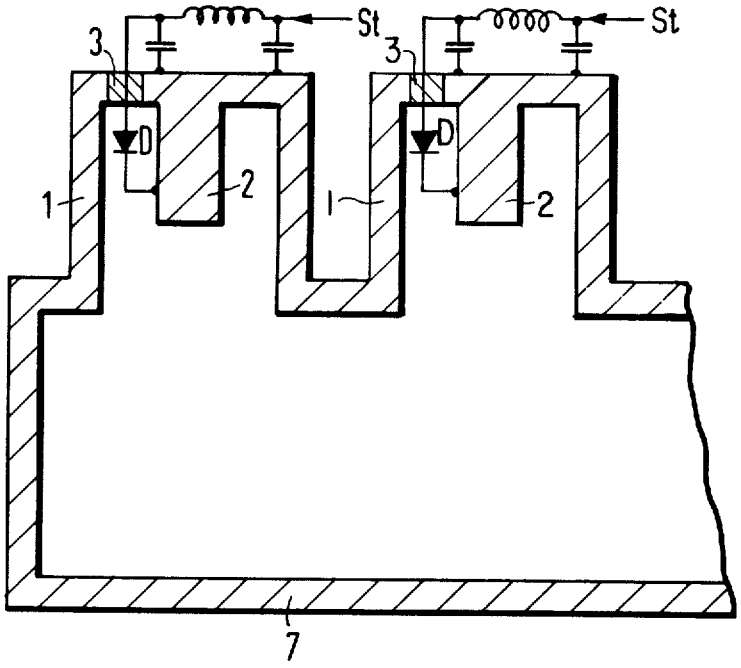
FIG. 6 illustrates the high frequency line section to which the resonator of FIG. 2 connects.

The equivalent circuit diagram as shown in FIG. 1 has a direct voltage supply section I, a section II with a microwave diode D, a coupling section III and a section IV with a microwave resonator in the form of a parallel resonant circuit consisting of an inductance L4, a capacitance C4 and a parallel resistance R4. Individual sections I through IV operate as follows. A network element consisting of transverse capacitances C1 and C2 with a longitudinal indictance L1 therebetween, are arranged in series with the direct voltage supply. This network functions as a short circuit for high frequencies. The microwave diode D functions as a switch or a variable capacitor C. The coupling section couples the diode circuit into the resonator. The microwave resonator establishes one of the frequencies for the coding of information by its resonant frequency. The microwave diode, the impedance of which may be changed by control voltage St, is connected to the direct voltage supply through the network. This diode is inductively coupled with a coupling factor $k$ through coupling section III to the microwave resonator. The resonator is constructed as a $\lambda/4$ coaxial resonator. The coupling may also occur capactively, however.

The control voltage St originates from a control voltage circuit 8 which has outputs St, St', St'', St''' etc. for each resonator to permit selective dampening of the individual resonators.

Preferably, a PIN diode is employed as the microwave diode and is operated as a controllable microwave resistance. When no voltage is connected to the PIN diode, or if an inverse voltage is connected thereto, the PIN diode exhibits a high microwave resistance (several $k$ ohms). If, on the contrary, a voltage is connected which operates the diode in a forward direction, the microwave resistance is lowered. The microwave resistance can be made very small (approximately 1 ohm) by use of a correspondingly high voltage (such as 1 volt).

By correctly selecting the coupling $k$ of the diode to the microwave resonator, the resonator is only slightly damped by the high diode resistance which is parallel to the microwave resonator during connection of a negative control voltage or, in an extreme case, a zero voltage. During connection of a positive control voltage, however, the resonator is very strongly damped and thereby switched inoperative by the parallel low diode resistance.

A varactor diode may also be employed as a microwave diode and operated as a controllable microwave capacitance. By connecting a corresponding and usually negative voltage, the microwave capacitance of the diode is changed.

The change in capacitance may occur continuously by the use of a diode in which the capacitance of the diode continuously increases with increasing inverse voltages. By use of an appropriate coupling of the diode capacitance to the microwave resonator, the resonant frequency of the resonator may be constantly tuned within a certain range by use of a control voltage.

It is also possible to have a sudden change in capacitance occur. This characteristic may be used to carry out the fine frequency changes with control voltages within a certain range period. In the so-called "dual stage" diode, by an appropriate doping of the semiconductor material the diode can essentially occupy only two defined capacitance values such that during connection of a control voltage below a specific value, the diode will have a capacitance value 1 and for voltages in excess of the specific value, it will have a capacitance value 2.

FIGS. 2, 3 and 4 illustrate different arrangements of the microwave diode on the resonator when the resonator is constructed as a coaxial resonator. In FIG. 2, the diode D is inside the resonator. In FIG. 3, the diode is inside a passage 3 located in a head portion of the resonator. In FIG. 4, it is arranged outside of the resonator. The coupling takes place inductively at the head portion of the container-like resonator such that the coupling section is conveyed through passage 3 and connects to an inner conductor 2 of the coaxial resonator 1. However, the coupling may couple into the resonator inductively as well as capacitively such that entry into the container-like resonator is possible on the side as well as on the open end. Activating the microwave diodes occurs via the direct voltage supply section, respectively consisting of elements L1, C1 and C2 such that transverse capacitances C1 and C2 are guided on one side to the exterior surface of the container head portion of the resonator 1. The connection of a coupling element to the interior element of the resonator, which may be difficult in the case of inductive coupling, may be avoided by returning an end of the coupling element to the top side of the resonator.

FIG. 5 illustrates an embodiment of the switchable resonator of this invention in which an insertable coupling section 4, an integrated diode chip D, and a drive plate bar 5 are provided. The insertion of diodes into glass housings or the direct installation of diode chips passivated with glass, insures a particularly simple construction for the resonator having a favorable cost factor. As a result of the small dimensions, a diode chip may be integrated into the coupling section as shown in the sample embodiment here. The coupling section 4 is inserted into channel 3 on the container head portion of the coaxial resonator 1 together with a diode chip D, whereby the diode chip D is located approximately in the area of the channel and the coupling section 4 projects vertically into the resonator space. The direct voltage supply section is mounted on a drive plate bar 5 arranged on the exterior surface of the head portion of the coaxial resonator 1. The electrical connection of the direct voltage supply to the diode chip D and coupling section 4 occurs via a soldered connection 6.

With the use of the various above-described diode types, it is possible to achieve a series of coding variations in the answering device. "$n$" may be coded with the resonators in the answering device. In a system which operates in the two out of five code, two or three resonators are required to be changed for each digit in order to represent the digits 0 through 9 in the inverse ZSC 3 or normal ZSC 3 code. In the following illustration, the state of each of the resonator frequencies is shown for both codes, using the example of the numeral 8:

| | | | | | | |
|---|---|---|---|---|---|---|
| | ZSC 3 | X | | | | X |
| inverse | ZSC 3 | | X | X | X | |
| frequency position | | 1 | 2 | 3 | 4 | 5 |

During the damping of the resonators by use of PIN diodes, when two resonators per digit are employed, the coding or change of an item of information occurs by switching off the resonators. When five resonators per digit are employed, all digits may be set from 0 to 9. Of the five resonators, two or three resonators depending upon the desired digit are switched inoperative with the aid of the PIN diodes so that the entire information may be coded or changed.

During continuous tuning by use of a varactor diode, each resonator undergoes a defined detuning within the desired frequency range when two resonators per digit are employed. Each resonator must be capable of being tuned or switched through four defined frequency positions. For example, a resonator 1 may be tuned or switched through frequency positions 1 through 4, and resonator 2 through frequency positions 2 through 5. If necessary, the entire information may also be changed. The resonators which are to be switched off may also be detuned in a range outside of the desired band with the aid of a varactor diode so that a total detuning results. When such total detuning is used, the answering device may again by provided with two resonators per digit or five resonators per digit whereby the mode of operation corresponds to that which was described in the case of damping by the use of PIN diodes.

If semiconductor diodes are employed which occupy several distinct capacitance conditions, each resonator may respond, for example, at two resonant frequencies. Thus, if there are two resonators per digit, the digit may be coded or set to four different numbers. If there are more resonators per digit, corresponding additional numbers per digit may be coded or set.

FIG. 6 illustrates a high frequency line section consisting of a hollow guide 7 along which the individual resonators are arranged. In FIG. 6, the connection of two of the resonators of the type shown in FIG. 2 is illustrated. In corresponding fashion, the resonators of FIGS. 3, 4 and 5 may also be arranged along the hollow guide 7.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. An answering device in a system for automatic wireless transmission of multi-digit information, particularly identifying indicia on railroad cars between interrogation devices and answering devices movable with respect to one another on movable carrier units, wherein each interrogation device transmits an interrogation signal which periodically varies its frequency within a predetermined microwave frequency band to which the answering device being moved past responds to frequencies for each digit of the information and sends back to the interrogation device a predetermined number of answering frequencies corresponding to each digit of the information, each answering device comprising:

a. a plurality of resonators coupled to a high frequency line section, said resonators each having a fixed frequency;

b. a microwave diode coupled to each resonator to switch the resonator inoperative when a control voltage is applied to said diode;

c. a control voltage means connected to the microwave diodes for switching inoperative certain of said resonators to set up the answering device for multi-digit information to be transmitted; and d. the resonators being constructed as containerlike hollow waveguides with head portions, the coupling of the microwave diode to the resonator taking place via an inductive coupling element through the head portion of the resonator.

2. The answering device of claim 1 in which the microwave diode is constructed as a diode-chip, and is integrated in the coupling element which can be inserted in an aperture of the resonator head portion.

3. The answering device of claim 2 in which lines for supplying the control voltage to the microwave diode are mounted on plate bar arranged on the external side of the resonator head portion.

4. An answering device in a system for automatic wireless transmission of multi-digit information between interrogation devices and answering devices movable with respect to one another on movable carrier units having an energy supply, numbers of railroad vehicles being transmitted to stationary interrogation devices, each interrogation device emitting an interrogation signal altering its frequency periodically in a prescribed frequency band situated in a microwave range from which the answering device selects frequencies assigned to the information as it moves past by means of resonators comprising high frequency cup-shaped line resonators, said resonators being tuned to the resonance of said frequencies for returning a prescribed number of answering frequencies to the interrogation device for each digit of the information, each answering device having a high frequency line section to which the resonators for the frequencies to be selected are respectively coupled, tuned resonators being provided for all of said frequencies, said resonators being individually switchable inoperative for setting up the multi-digit information by strong damping, a microwave PIN diode coupled in each resonator for damping the resonator by applying control voltages to the microwave diode, said diode being provided as a diode-chip integrated in an inductive coupling element insertable into an aperture in a bottom of the cup-shaped resonator.

5. An answering device in a system for automatic wireless transmission of multi-digit information between interrogation devices and answering devices movable with respect to one another on movable carrier units having an energy supply, numbers of railroad vehicles being transmitted to stationary interrogation devices, each interrogation device emitting an interrogation signal altering its frequency periodically in a prescribed frequency band situated in a microwave range from which the answering device selects frequencies assigned to the information as it moves past by means of resonators comprising high frequency cup-shaped line resonators, said resonators being tuned to the resonance of said frequencies for returning a prescribed number of answering frequencies to the interrogation device for each digit of the information, each answering device having a high frequency line section to which the resonators for the frequencies to be selected are respectively coupled, tuned resonators being provided for all of said frequencies, said resonators being individually switchable inoperative for setting up the multi-digit information by strong detuning, a microwave varactor diode coupled in each resonator for detuning the resonator by applying control voltages to the microwave diode, said diode being provided as a diode-chip integrated in an inductive coupling element insertable into an aperture in a bottom of the cup-shaped resonator.

* * * * *